US006386698B2

(12) United States Patent
Suga et al.

(10) Patent No.: US 6,386,698 B2
(45) Date of Patent: May 14, 2002

(54) METHOD OF ENHANCING TRANSFER PRINTING QUALITY

(75) Inventors: Shoji Suga; Eiji Miya; Hideo Uchida; Tadao Arai, all of Tokyo (JP)

(73) Assignee: Megami Ink Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/880,300

(22) Filed: Jun. 13, 2001

(30) Foreign Application Priority Data

Jun. 13, 2000 (JP) ..... 2000-176573

(51) Int. Cl.[7] ..... B41J 2/01
(52) U.S. Cl. ..... 347/103
(58) Field of Search ..... 347/100, 103, 347/188, 15; 400/120.09; 399/29, 30

(56) References Cited

U.S. PATENT DOCUMENTS 4,923,846 A 5/1990 Kutsukake et al.
5,047,084 A 9/1991 Miller et al.
5,308,825 A * 5/1994 Defieuw ..... 503/227
5,405,822 A 4/1995 Landgrebe et al.
5,684,063 A 11/1997 Patel et al.
5,746,816 A 5/1998 Xu
5,805,780 A * 9/1998 Kawai et al. ..... 395/117
5,835,117 A 11/1998 Small

* cited by examiner

*Primary Examiner*—Raquel Y. Gordon
*Assistant Examiner*—Ly T Tran
(74) *Attorney, Agent, or Firm*—Greensfelder Hemker & Gale, P.C.

(57) ABSTRACT

A method of transfer printing for increasing the reproducibility in achieving high-precision, high-brilliance transfer prints by controlling the print density of yellow sublimate ink on the transfer material within a specified range of yellow density. The invention has application in transfer printing methods where a digitized image is produced on a transfer material by printing the image from a PC by a ink jet printer using sublimate ink. The printed image on the transfer material is transferred to a print medium by heat processing. The other colors of the image are adjusted based upon the print density of yellow sublimate ink falling within the specified range.

16 Claims, No Drawings

METHOD OF ENHANCING TRANSFER PRINTING QUALITY

FIELD OF THE INVENTION

The present invention relates to transfer printing methods, more specifically, to the transfer printing method of printing images by a non-plate electronic print system onto a transfer material using sublimate ink, laying the transfer material ink-side down on top of a print medium, and transferring the print image from the transfer material to the print medium by heat processing the transfer material. The reproducibility of the colors of the transfer material transferred to the print medium is improved by controlling the print density of the yellow sublimate ink on the transfer material within a specific range of yellow density.

BACKGROUND OF THE INVENTION

At present, mainstream transfer printing consists of two methods: the wet transfer method and the dry transfer method. Images are printed first on the transfer material such as paper and plastic film by screen printing or offset printing, then the images are transferred onto the print medium such as glass, metal, plastic or fabric by water, or by heat or pressure, respectively.

However, the above methods require the preparation of a print original for the purpose of screen printing or offset printing, which is time-consuming and costly. It is not suitable for low volume, multiple-type printing, and is impractical in adapting to an ever-changing demand by consumers for new and different designs.

In recent years, it has become very common to sell T-shirts and other merchandise prepared by the following process: Images are printed with a sublimate ink on the transfer material, then such transfer material is used to transfer various images onto T-shirts, aprons, luncheon mats, streamers, stickers, panels, coasters, and the like, by heat-contact printing which sublimates the ink, using an iron. Because of the vast range of consumers' taste and style, which constantly change, there is a demand for low volume, multiple-type printing. This is not compatible with screen printing or off-set printing, which requires the costly and time-consuming preparation of a print original.

In light of such developments, a non-plate electronic print system has been introduced. Images created by digital cameras and scanners, and the like, are inputted to a personal computer (PC) and edited as desired. The images can be printed on the transfer material by an ink jet printer connected to the PC. The images, which are formed of sublimate ink, are then transferred onto the print medium using a heat iron. U.S. Pat. Nos. 5,047,084, 5,684,063, and 5,746,816 disclose such methods.

Such transfer printing using the non-plate electronic printing system permits very easy printing of images onto the transfer material and is suitable for low-volume, multiple-type printing. This method has become popular in recent years since it permits quick changes to meet changing fashion trends.

However, transfer printing using sublimate ink creates a large discrepancy between the colors first printed on the transfer material and those subsequently transferred onto the print medium from the transfer material. The ultimate color of the final images is very difficult to control when printing onto the transfer material. Repeated proof prints are needed to adjust colors prior to printing onto the print medium to provide reproducibility.

Such procedures are acceptable to a certain extent in transfer printing using screen printing or off-set printing, which are based on high volume printing. However, in transfer printing by the non-plate electronic print system for low-volume, multiple type printing, the process has been undesirable due to the disproportionate costs of set-up versus the revenue realized from the job.

It is desirable to increase the reproducibility of the color consistency of the transfers in order to minimize off-color prints prior to the final printing and to minimize the loss of print medium.

The present invention provides a transfer printing method for controlling the reproducibility of the transferred colors, and provides high density, high brilliance transfer prints, minimizing loss through off-color prints.

SUMMARY OF THE PRESENT INVENTION

The present invention relates to the discovery that yellow sublimate ink undergoes little color change during the initial printing stage onto transfer material, as well as after transfer of the image onto print medium. The yellow density is transferred with stability among the three primary colors of red, yellow and blue during printing. It has been discovered that by maintaining the printing density of yellow sublimate ink within a specific range of yellow density during transfer onto transfer material, it is possible to enhance the reproducibility of high density, high brilliance transfer print images on the print medium.

The present invention comprises a transfer printing method which controls the printing density of yellow sublimate ink forming the image on the transfer material within a specific range of yellow density during the transfer print. Sublimate ink is printed onto the transfer material by means of a non-plate electronic printing system. The transfer material is laid on top of the print medium and the image is heat-transferred by sublimation of the ink from the image onto the print medium. The number of correction prints is reduced using the present invention. Reproducible, high density, high brilliance transfer prints are made by adjusting sublimate ink other than the yellow sublimate ink, which functions as the base color, based on images transferred onto the print medium. The yellow sublimate ink is controlled when applied to the transfer material to provide a high density, high brilliance transfer onto the print medium.

Additionally, the invention can prevent ruining the print medium along with ruined transfer material because such transfer material can be discarded when its yellow density of yellow sublimate ink does not fall within a specific range, before printing onto the print medium.

More specifically, it is desirable to control the yellow density on the solid printed area on the transfer material of yellow sublimate ink. Further, it is desirable to control the yellow density of the solid printed area within the range of 0.7–0.9. The density measurement is most accurate when measured on solid printed areas.

It is unlikely to obtain high density, high brilliance transfer prints on the print medium of various types when the yellow density is below 0.7 on the solid printed areas in the transfer material of yellow sublimate ink. Density over 0.9 causes images on the print medium to become blurry and the images themselves to be destroyed. Further, there may be frequent clogging of the nozzle of ink jet printers.

The yellow density described in the present invention means the yellow density measured by a densitometer manufactured based on JIS K 7654 "Photography, Density Measurement Part 4, Geometric Conditions for Reflection Density" (translation of ISO5/4, first edition, published in 1983), i.e. Gretag D 196 (trademarked) by Gretag-Macbeth AG. The print density ratio is the log of the intensity of the reflected light from the yellow density of the solid printed area divided by the intensity of the incident light.

DETAILED DESCRIPTION OF THE INVENTION

Given below is the best mode of execution of the present invention. The present invention is not, however, limited by the following disclosure.

Sublimate Ink

The sublimate ink employed in the present invention is ink containing dyes which sublimate at certain temperatures, in this case, those temperatures achieved by a heating iron. The main components of sublimate inks are dyes, water, solvent and dispersant. Ink jet printer ink may be used.

The sublimate ink may be yellow ink, crimson ink, indigo ink and black ink, and are prepared by mixing the yellow sublimate dye, red sublimate dye and blue sublimate dye in proper proportions (See Table 1 below). In order to expand their range of expression, green, orange, violet and fluorescent ink may also be used.

TABLE 1

| | yellow dye | red dye | blue dye |
|---|---|---|---|
| yellow ink | □ | × | × |
| crimson ink | ■ | □ | ○ |
| indigo ink | ■ | ■ | □ |
| black ink | □ | ○ | □ |

□: high volume
○: approximately 5–40%
■: adjustment volume less than 5%
×: not added For yellow sublimate dye, C.I Disperse Yellow 1, 3, 5, 7, 13, 23, 42, 51, 54, 61, 71, 82, 114, 141, 201 and E, as well as E-GRL can be used and, specifically, KAYASET YELLOW A-G (trademarked) by Nippon Kayaku Co., Ltd. is preferred. KAYASET YELLOW A-G has an absorption rate of 2.0/100 mg at 400 nm (λmax) and is commonly used as yellow ink as a solution containing solvents of dye concentration at 1–2 wt %.

For red sublimate dye, C.I. Disperse Red B, 1, 4, 17, 59, 60, 135, 167, and 210 can be used and specifically KAYASET RED B (trademarked) by Nippon Kayaku Co., Ltd., is preferred.

For blue sublimate dye, C.I. Disperse Blue 3, 14, 24, 26, 56, 92, and 106 can be used and, specifically, KAYASET BLUE FR (trademarked) by Nippon Kayaku Co., Ltd., is preferred.

The amount of water desirable as a main component in the sublimate ink is in the range of from about 10–93 wt %, preferably in the range from about 25–87 wt %, and more preferably from about 30–80 wt % of the total ink volume.

Suitable solvents include the organic solvents of ketone or ketone alcohol such as acetone and diacetone alcohol the concentration being from about 3–60 wt %, preferably from about 5–50% of the total ink volume. Other suitable organic solvents include alcohols, esters, ethers, and N-methyl-2-pyrolidone.

When dispersants are used, they may be used singly or in a mixture. The preferred dispersant contains solvent with a vapor pressure of about 0.1 mmHg or less (20° C.). Such solvents may be single thioglycol, or diethylene glycol, propylene glycol and surface active agents alone or in mixtures.

Transfer Material

The transfer material for the present invention may be paper or plastic film, or specially designed paper for the sublimation transfer using ink jet printing. Specifically, the preferred sublimation transfer material available on the market is sold by Mitsubishi Paper Mills, Ltd.

Prints on Transfer Material

Printing of images on transfer material in the present invention is done by non-plate electronic printing system. Non-plate electronic printing system permits the use of a PC and an ink jet printer connected to the PC. For example, images are taken from a digital camera or scanner, and the like, edited, and then printed with sublimate ink onto transfer material by means of an ink jet printer connected to the PC.

The yellow density of the yellow sublimate ink on the solid printed area on the transfer material is controlled within the range of about 0.7 to 0.9. The yellow density is measured by using a densitometer directed at the yellow sublimate ink on the solid printed area. The print density ratio is the log of the intensity of the reflected light from the yellow density of the solid printed area divided by the intensity of the incident light.

Dr=Print Density by measuring light reflection for each color;

Lo=strength of incident light;

Lr=strength of reflection light;

Dr=log(Lo/Lr).

Suitable densitometers include Gretag D 196 (registered trademarked) by Gretag-Macbeth AG. The discharge volume of yellow sublimate ink from the inkjet printer or the volume of yellow dye in the yellow sublimate ink can be adjusted after the yellow density is measured to yield yellow density in the range of about 0.7 to 0.9.

Print Medium

The print medium used in the present invention may be, albeit not limited to, polyester cloth, T-shirts, aprons, luncheon mats, streamers, stickers, panels, and coasters.

Method of Transferring onto the Print Medium

The transfer material is laid print side-down, on top of the said print transfer medium. The transfer material is heat-pressed with hot press, iron, or the like, to sublimate the sublimate dye and to transfer the images on the transfer material onto the print medium. Normal transfer is achieved by heat pressing under the condition of 150–250° C. for 10–120seconds, preferably for 20–60 seconds.

Using the yellow color of the yellow sublimate ink in the images transferred onto the print medium as a basis, the discharge volume of remaining crimson, indigo and black sublimate ink from the ink jet printer is adjusted or, alternately, the dye volume in the sublimate ink of said colors is adjusted.

In general, the four process colors for any printed matters have to be balanced in terms of color itself and color density for each of the four colors in order to reproduce the accurate and realistic image areas. Any photo pictures have to be reproduced exactly the same as the real images, simulating the original colors, regardless of the type of printing method. These can be realized by the balanced four process colors. Due to well balanced four color process colors in terms of color and density on printed matter, the three other colors can be automatically determined in terms of color and density, once the first color having a specific density gets chosen as the standard color. This invention discloses that yellow is found to be the best, and is the one chosen as the standard single color for ensuring reproducibility of print images in the ink jet sublimation printing system.

Yellow sublimate ink is used as a basis, the density of which is in the range of 0.7–0.9 on the solid printed area on the transfer material, while printing the images and the solid printed area on the transfer material using the remaining sublimate ink of crimson, indigo and black. The images and the solid printed area are transferred onto the print medium, the density of crimson, indigo and black being measured respectively on the solid printed area on the print medium using a densitometer, such as Gretag D-196 (trademarked) by Gretag-Macbeth AG. The volume of sublimate ink dyes can be adjusted, respectively, so that the crimson density is at 1.3–1.6, indigo density at 0.5–1.1 and black density at 1.2–1.8 while simultaneously fine-adjusting visually the crimson, indigo and black colors by using the yellow sublimate ink on the print medium as the base color.

By adopting the transfer printing method of the present invention, it becomes possible to radically reduce the number of correction prints prior to the print onto the print medium, as well as to minimize the number of failed print mediums.

The invention also permits printing on the transfer material by an ink jet printer based on a prior computer input of correction data on the ink jet printer discharge of the sublimate ink of the colors (crimson, indigo and black), in addition to yellow for respective print medium, if the yellow density of yellow sublimate ink on the solid printed area is measured and is confirmed that such density falls within the specified range.

EXAMPLES

Examples of the preferred embodiment of the invention are given below. The claimed invention is not limited in any way by the following examples.

Example 1

Images taken from a digital camera to a PC were printed in various densities on sublimation transfer paper manufactured by Mitsubishi Paper Mills, Ltd. by means of an ink jet printer "MJ-6000C" by Seiko Epson Corp. in which yellow, crimson, indigo and black sublimate ink by MEGAMI INK MFG. CO., LTD. had been set.

The respective densities in yellow, crimson, indigo and black colors of sublimate ink on the solid printed area on the transfer material obtained were measured using Gretag D196 (trademarked) by Gretag-Macbeth AG, respectively. The measured results are given in Tables 2–7.

The images on the transfer material were transferred by hot press at 180° C. for 30 seconds on three kinds of print medium consisting of EX-007 E-1 White (print medium A) by Masuda INC., original polyester cloth product (print medium B) by ATLIER GRAY INC., and S-9002 (print medium C) by Teijin Ltd., respectively.

In Tables 2–7 are the evaluations of the images transferred onto the print medium as well as yellow, crimson, indigo and black densities of respective sublimate ink on the solid printed area measured by Gretag D196 (trademarked) densitometer by Gretag-Macbeth AG.

TABLE 2

| | | yellow density | crimson density | indigo density | black density |
|---|---|---|---|---|---|
| Transfer material | yellow ink | 0.63 | 0.07 | 0.02 | 0.05 |
| | crimson ink | 0.90 | 1.19 | 0.43 | 1.00 |
| | indigo ink | 0.30 | 0.38 | 0.52 | 0.44 |
| | black ink | 1.02 | 1.30 | 1.00 | 1.12 |
| Print medium A | yellow ink | 0.66 | 0.05 | 0.02 | 0.04 |
| | crimson ink | 0.80 | 1.40 | 0.20 | 0.81 |
| | indigo ink | 0.18 | 0.60 | 0.61 | 0.54 |
| | black ink | 0.92 | 1.35 | 0.95 | 1.12 |
| Print medium B | yellow ink | 0.50 | 0.04 | 0.01 | 0.02 |
| | crimson ink | 0.78 | 1.20 | 0.18 | 0.79 |
| | indigo ink | 0.15 | 0.50 | 0.58 | 0.48 |
| | black ink | 0.80 | 1.01 | 0.90 | 0.98 |
| Print medium C | yellow ink | 0.55 | 0.04 | 0.02 | 0.03 |
| | crimson ink | 0.80 | 1.09 | 0.19 | 0.81 |
| | indigo ink | 0.17 | 0.38 | 0.59 | 0.50 |
| | black ink | 0.85 | 1.08 | 0.90 | 1.03 |
| Result | Red is strong in images on print medium overall, with no modulation. Evaluation: unacceptable | | | | |

TABLE 3

| | | yellow density | crimson density | indigo density | black density |
|---|---|---|---|---|---|
| Transfer material | yellow ink | 0.72 | 0.07 | 0.01 | 0.05 |
| | crimson ink | 1.21 | 1.44 | 0.74 | 1.34 |
| | indigo ink | 0.38 | 0.54 | 0.66 | 0.59 |
| | black ink | 1.70 | 1.78 | 1.55 | 1.77 |
| Print medium A | yellow ink | 0.80 | 0.04 | 0.02 | 0.03 |
| | crimson ink | 0.96 | 1.68 | 0.25 | 0.95 |
| | indigo ink | 0.18 | 0.55 | 1.10 | 0.72 |
| | black ink | 1.80 | 1.75 | 1.39 | 1.78 |
| Print medium B | yellow ink | 0.69 | 0.02 | 0.01 | 0.02 |
| | crimson ink | 0.85 | 1.30 | 0.22 | 0.85 |
| | indigo ink | 0.20 | 0.48 | 0.91 | 0.60 |
| | black ink | 1.40 | 1.50 | 1.19 | 1.51 |
| Print medium C | yellow ink | 0.70 | 0.03 | 0.02 | 0.03 |
| | crimson ink | 0.90 | 1.40 | 0.23 | 0.85 |
| | indigo ink | 0.20 | 0.50 | 0.98 | 0.65 |
| | black ink | 1.68 | 1.67 | 1.22 | 1.50 |
| Result | Print medium obtained was good, with high-density and high-brilliance. Evaluation: Excellent | | | | |

TABLE 4

| | | yellow density | crimson density | indigo density | black density |
|---|---|---|---|---|---|
| Transfer material | yellow ink | 0.79 | 0.07 | 0.02 | 0.05 |
| | crimson ink | 1.26 | 1.49 | 0.73 | 1.36 |
| | indigo ink | 0.40 | 0.58 | 0.73 | 0.64 |
| | black ink | 1.72 | 1.80 | 1.55 | 1.78 |
| Print medium A | yellow ink | 0.83 | 0.04 | 0.03 | 0.04 |
| | crimson ink | 0.99 | 1.72 | 0.28 | 1.00 |
| | indigo ink | 0.29 | 0.60 | 1.13 | 0.74 |
| | black ink | 1.84 | 1.89 | 1.44 | 1.87 |
| Print medium B | yellow ink | 0.72 | 0.02 | 0.01 | 0.02 |
| | crimson ink | 0.90 | 1.39 | 0.23 | 0.88 |
| | indigo ink | 0.24 | 0.51 | 0.95 | 0.64 |
| | black ink | 1.59 | 1.60 | 1.23 | 1.57 |
| Print medium C | yellow ink | 0.77 | 0.03 | 0.01 | 0.03 |
| | crimson ink | 0.95 | 1.40 | 0.23 | 0.91 |
| | indigo ink | 0.24 | 0.55 | 1.10 | 0.69 |
| | black ink | 1.72 | 1.71 | 1.28 | 1.70 |
| Result | Print medium obtained was good, with high-density and high-brilliance. Evaluation: Excellent | | | | |

TABLE 5

| | | yellow density | crimson density | indigo density | black density |
|---|---|---|---|---|---|
| Transfer material | yellow ink | 0.88 | 0.10 | 0.05 | 0.09 |
| | crimson ink | 1.36 | 1.49 | 0.82 | 1.39 |
| | indigo ink | 0.50 | 0.61 | 0.83 | 0.78 |
| | black ink | 1.80 | 1.88 | 1.60 | 1.78 |
| Print medium A | yellow ink | 0.90 | 0.08 | 0.05 | 0.07 |
| | crimson ink | 1.08 | 1.52 | 0.58 | 1.09 |
| | indigo ink | 0.40 | 0.61 | 1.20 | 0.80 |
| | black ink | 1.81 | 1.90 | 1.60 | 1.80 |
| Print medium B | yellow ink | 0.88 | 0.04 | 0.03 | 0.05 |
| | crimson ink | 0.99 | 1.32 | 0.50 | 0.95 |
| | indigo ink | 0.45 | 0.60 | 1.00 | 0.75 |
| | black ink | 1.71 | 1.65 | 1.40 | 1.72 |
| Print medium C | yellow ink | 0.90 | 0.05 | 0.04 | 0.05 |
| | crimson ink | 1.02 | 1.42 | 0.55 | 1.01 |
| | indigo ink | 0.42 | 0.61 | 1.10 | 0.80 |
| | black ink | 1.76 | 1.72 | 1.52 | 1.78 |
| Result | Print medium obtained was good, with high-density and high-brilliance. Evaluation: Excellent | | | | |

TABLE 6

| | | yellow density | crimson density | indigo density | black density |
|---|---|---|---|---|---|
| Transfer material | yellow ink | 0.89 | 0.10 | 0.04 | 0.08 |
| | crimson ink | 1.37 | 1.49 | 0.83 | 1.30 |
| | indigo ink | 0.50 | 0.62 | 0.80 | 0.80 |
| | black ink | 1.81 | 1.87 | 1.59 | 1.77 |
| Print medium A | yellow ink | 0.90 | 0.07 | 0.05 | 0.07 |
| | crimson ink | 1.08 | 1.50 | 0.58 | 1.09 |
| | indigo ink | 0.39 | 0.60 | 1.20 | 0.81 |
| | black ink | 1.80 | 1.79 | 1.57 | 1.80 |
| Print medium B | yellow ink | 0.87 | 0.04 | 0.03 | 0.04 |
| | crimson ink | 0.98 | 1.32 | 0.53 | 0.94 |
| | indigo ink | 0.35 | 0.58 | 0.98 | 0.75 |
| | black ink | 1.70 | 1.70 | 1.40 | 1.70 |
| Print medium C | yellow ink | 0.90 | 0.04 | 0.04 | 0.05 |
| | crimson ink | 1.10 | 1.46 | 0.58 | 1.09 |
| | indigo ink | 0.43 | 0.65 | 1.13 | 0.81 |
| | black ink | 1.79 | 1.72 | 1.60 | 1.72 |
| Result | Print medium obtained was good, with high-density and high-brilliance. Evaluation: Excellent | | | | |

TABLE 7

| | | yellow density | crimson density | indigo density | black density |
|---|---|---|---|---|---|
| Transfer material | yellow ink | 1.08 | 0.16 | 0.05 | 0.08 |
| | crimson ink | 1.45 | 1.60 | 0.92 | 1.35 |
| | indigo ink | 0.60 | 0.68 | 0.88 | 0.85 |
| | black ink | 1.89 | 1.85 | 1.64 | 1.79 |
| Print medium A | yellow ink | 1.12 | 0.09 | 0.05 | 0.08 |
| | crimson ink | 1.20 | 1.56 | 0.62 | 1.14 |
| | indigo ink | 0.49 | 0.68 | 1.32 | 0.85 |
| | black ink | 1.88 | 1.82 | 1.65 | 1.84 |
| Print medium B | yellow ink | 1.10 | 0.04 | 0.04 | 0.04 |
| | crimson ink | 1.15 | 1.39 | 0.56 | 0.99 |
| | indigo ink | 0.49 | 0.58 | 1.03 | 0.79 |
| | black ink | 1.82 | 1.73 | 1.49 | 1.72 |
| Print medium C | yellow ink | 1.09 | 0.04 | 0.05 | 0.06 |
| | crimson ink | 1.16 | 1.49 | 0.68 | 1.13 |
| | indigo ink | 0.50 | 0.71 | 1.15 | 0.87 |
| | black ink | 1.85 | 1.79 | 1.67 | 1.73 |
| Result | Though images on print medium are in high density, thin spots were present. Evaluation: Unacceptable | | | | |

Tables 2–7 above demonstrate that yellow sublimate ink shows little change in hue when printed onto the transfer material. After the image is transferred onto various pieces of print medium, there is little change in yellow density.

What is also shown is that, in order to obtain transfer images onto the print medium with high-density and high-brilliance, the yellow density measured on the solid printed area should be in the range between 0.7–0.9. Once the color density of yellow gets determined on the print medium, for example about 0.7, the remaining three colors such as crimson, indigo and black, can be automatically determined in their color and density, for example, 0.03, 0.02, and 0.03, respectively as shown in Table 3, due to the well balanced four process color printing system. Once the four colors get balanced out on the print medium, like that shown in Table 3, one can establish what kind of sublimation pigment should be selected and how much pigmentation should be loaded in each of the four color ink formulation, in order to reproduce the balanced four color prints.

Thus, as shown in Tables 2–7, only yellow ink reproduces consistent and identical color density both on transfer materials and on print mediums. This indicates that it is possible to reproduce consistent four color process prints on print mediums once you determine the density of yellow alone on transfer materials in sublimation printing systems. Accordingly, this invention specifies that the range of yellow ink density of the print image on the transfer material should be 0.7–0.9 for best reproducibility on print mediums.

Example 2

Yellow sublimate ink with the composition given below was used in the ink jet cartridge and printed on the sublimation transfer paper manufactured by Mitsubishi Paper Mills, Ltd. by using an ink jet printer "MJ-6000C" produced by Seiko Epson Corp.

After printing, yellow density on the solid printed area and 10–90% dots were measured respectively by using Gretag D196 (trademarked) densitometer by Gretag-Macbeth AG The measured results are given in Table 8.

The images on the transfer material were transferred with a hot press under the transfer condition of 200° C. for 30 seconds onto the print medium (polyester cloth) and yellow density of the transferred images on the solid printed area as well as 10–90% dots were measured respectively by using Gretag D 196 (trademarked) by Gretag-Macbeth AGO and the measured results are given in Table 8.

| | | |
|---|---|---|
| Dot 90% | 0.73 | 0.89 |
| Dot 80% | 0.63 | 0.85 |
| Dot 70% | 0.53 | 0.82 |
| Dot 60% | 0.45 | 0.72 |
| Dot 50% | 0.38 | 0.66 |
| Dot 40% | 0.32 | 0.59 |
| Dot 30% | 0.24 | 0.52 |
| Dot 20% | 0.12 | 0.31 |
| Dot 10% | 0.05 | 0.15 |

Table 8, above, demonstrates that the sublimation transfer of yellow sublimate ink takes place with stability at respective dots. It is possible to obtain high-density, high-brilliance transfer images onto the print medium by controlling within a specific density range the yellow density at 90% dots in the solid printed area of yellow sublimate ink on the transfer material.

Statement
Composition of Yellow Sublimate Ink

| | | |
|---|---|---|
| 1. | Dye dispersant | 2.0 wt % |
| | KAYASET YELLOW A-G | |
| | Surfynol | 0.8 wt % |
| | thioglyco | 0.8 wt % |
| | water | 94.4 wt % |
| 2. | Yellow ink | 87.0 wt % |
| | dye dispersant | |
| | thioglycol | 4.0 wt % |
| | diacetone alcohol | 7.0 wt % |
| | water | 2.0 wt % |

Example 3

Based on the yellow sublimate ink used in Example 2, dye density of other sublimate ink (crimson, indigo and jet-black) was checked by matching with the print medium used (polyester cloth).

The sublimate ink of the above four colors were set in the cartridge and printed on the sublimation transfer paper produced by Mitsubishi Paper Mills, Lid. by means of the ink jet printer used in Example 2. The image transfer from the transfer material onto the print medium was repeated ten times by hot-pressing at 200° C. for 30 seconds after placing the transfer material on top of the print medium (polyester cloth). All of the images formed high-density, highbrilliance transfer print images.

Since the transfer printing method of the present invention thus described controls the yellow sublimate ink in a condition permitting reproducible, high-precision, high-brilliance transfer prints onto the print medium during the stage of transfer material prints, one gains the advantage of radically reducing correction prints by adjusting the remaining sublimate inks based on the yellow sublimate ink as the base color from the images after transfer onto the transfer medium.

At the same time, the transfer printing method of the present invention gives the advantage of preventing print medium failures. Failed transfer material, whose yellow density of the yellow sublimate ink is not in a specified range during the printing stage on the transfer material, can be discarded as such.

Various changes and modifications may be made within this invention as will be apparent to those skilled in the art. Such changes and modifications are within the scope and teaching of this invention as defined in the claims appended hereto.

What is claimed is:

1. A transfer printing method comprising applying a print image comprised of sublimate ink onto a transfer material by a non-plate electronic print system, laying said transfer material ink side-down on top of a print medium, and transferring said print image from said transfer material to said print medium by heat processing said transfer material, wherein a print density of yellow sublimate ink of said print image on said transfer material is controlled within a specific range of yellow density to improve quality reproducibility of said print image onto said print medium.

2. The transfer printing method of claim 1, wherein said print density of said yellow sublimate ink onto said transfer material is controlled within a density range of 0.7 to 0.9.

3. The transfer printing method of claim 1, wherein said print density of said yellow sublimate ink onto said transfer material is controlled within a density range of about 0.7 to 0.9.

4. The transfer printing method of claim 1, wherein said non-plate electronic print system comprises a personal computer and an ink jet printer connected to said personal computer.

5. The transfer printing method of claim 4, wherein said sublimate ink is jet printer ink comprising sublimate dye, solvent, dispersant and water.

6. The transfer printing method of claim 5, wherein said sublimate dyes include direct dye and dispersed dye.

7. The transfer printing method of claim 1 in which said print image is produced of primary colors comprising yellow, crimson, indigo and black inks, wherein print densities of said crimson, indigo and black inks are adjusted in relation to said controlled print density of said yellow ink.

8. The transfer printing method of claim 7 in which the print density of said yellow sublimate ink onto the transfer material is controlled within the density range of 0.7 to 0.9, and the print densities of said crimson, indigo and black inks on said print medium are adjusted in relation to said controlled print density range of said yellow sublimate ink to fall within a range of 1.3–1.6, 0.5–1.1 and 1.2–1.8, respectively.

9. The transfer printing method of claim 7 in which the print density of said yellow sublimate ink onto the transfer material is controlled within the density range of about 0.7 to 0.9, and the print densities of said crimson, indigo and black inks on said print medium are adjusted in relation to said controlled print density range of said yellow sublimate ink to fall within a range of about 1.3–1.6, 0.5–1.1 and 1.2–1.8, respectively.

10. The transfer printing method of claim 1 in which said print density of yellow sublimate ink on said transfer material is controlled by measuring said density of said yellow sublimate ink on a solid printed area on said transfer material with a densitometer, and adjusting said yellow sublimate ink such that said density falls within a range of 0.7–0.9.

11. The transfer printing method of claim 10 in which said non-plate electronic print system is a personal computer and an ink jet printer connected to said personal computer, said yellow sublimate ink being adjusted by modifying a discharge volume of said yellow sublimate ink from said ink jet printer.

12. The transfer printing method of claim 10 in which said yellow sublimate ink is adjusted by modifying a volume of yellow dye in said yellow sublimate ink.

13. The transfer printing method of claim 1 in which said print density of yellow sublimate ink on said transfer material is controlled by measuring said density of said yellow sublimate ink on a solid printed area on said transfer material with a densitometer, and adjusting said yellow sublimate ink such that said density falls within a range of about 0.7–0.9.

14. The transfer printing method of claim 13 in which said non-plate electronic print system is a personal computer and an ink jet printer connected to said personal computer, said yellow sublimate ink being adjusted by modifying a discharge volume of said yellow sublimate ink from said ink jet printer.

15. The transfer printing method of claim 13 in which said yellow sublimate ink is adjusted by modifying a volume of yellow dye in said yellow sublimate ink.

16. The transfer printing method of claim 1 in which transfer material bearing print images having a print density of yellow sublimate ink falling within said specific range is retained for reproducing said print image on said print medium, while transfer material bearing print images having a print density of yellow sublimate ink falling outside said specific range is discarded.

* * * * *